United States Patent [19]

Hjertman et al.

[11] Patent Number: 4,567,999

[45] Date of Patent: Feb. 4, 1986

[54] SELF-ADHESIVE CONNECTING DEVICE

[75] Inventors: Birger T. Hjertman, Vällingby; Percy E. Bennwik, Saltsjö-Boo, both of Sweden

[73] Assignee: International Nutritional Research Institute AB, Stockholm, Sweden; a part interest

[21] Appl. No.: 456,054

[22] PCT Filed: May 5, 1982

[86] PCT No.: PCT/SE 82/00152

§ 371 Date: Jan. 5, 1983

§ 102(e) Date: Jan. 5. 1983

87] PCT Pub No.: WO 82/03776

PCT Pub. Date: Nov. 11, 1982

[30] Foreign Application Priority Data

May 7, 1981 [SE] Sweden ..... 8102868

[51] Int. Cl.[4] ..... B67B 7/48

[52] U.S. Cl. ..... 222/83; 222/89; 604/408; 604/411

[58] Field of Search ..... 222/81, 83, 80, 89; 604/408, 411, 414, 262, 409, 410; 285/3, DIG. 16

[56] References Cited

U.S. PATENT DOCUMENTS

| | | | |
|---|---|---|---|
| 2,704,075 | 3/1955 | Cherkin | 222/81 |
| 2,856,929 | 10/1958 | Gossett et al. | 604/408 |
| 3,172,570 | 3/1965 | Lipschutz | 222/81 X |
| 3,930,286 | 1/1976 | McGowen | 222/83 |
| 4,022,205 | 5/1977 | Tenczar | 604/411 |
| 4,381,776 | 5/1983 | Latham | 604/411 |

*Primary Examiner*—Joseph J. Rolla
*Assistant Examiner*—Frederick R. Handren
*Attorney, Agent, or Firm*—Burns, Doane, Swecker & Mathis

[57] ABSTRACT

A device for providing a sealed liquid connection with the interior of a liquid container of a flexible sheet material, a point (8) being made to penetrate the wall (11) of the container to achieve a connection for supplying or withdrawal of liquid. According to the invention, the device is provided with a pressure sensitive adhesive (5) on a surface (4) which is intended to be applied to the container wall (11), the adhesive adhering to the container wall (11) and being arranged so that the area adhering to the container wall (11) surrounds the area where the point (8) penetrates the container wall (11). The device is intended to be applied to the container after manufacture and filling of the container and before liquid is to be added or withdrawn.

2 Claims, 11 Drawing Figures

SELF-ADHESIVE CONNECTING DEVICE

This invention relates to a device for providing a sealed liquid connection with the interior of a liquid container made of a flexible sheet material.

Packages of flexible sheet materials for liquids of various types have been widely used and have a number of advantages. Among various fields of use, packages for foodstuffs and various pharmacological preparations can be mentioned as examples, and among the many advantages it can be mentioned for example, that the packages are light, durable and can be produced in large numbers at a low price. Moreover, it is possible to produce and also to fill the packages under sterile conditions so that the sterility of the contents is assured. By a selection of suitable heat-resistant materials, the packages can also be heat sterilized with their contents.

One disadvantage of packages of flexible foil materials has been that it has often been difficult to make a connection to the package for drawing off its contents or adding a material to its contents. As the wall material of the package is flexible and without any great rigidity, it can be difficult to obtain a liquid-tight and leakproof connection. This problem will be still greater when at the same time the contents of the packages are to be kept sterile during and after tapping or at addition of material to the package. Soft packages of plastic foil have for example been widely used for solutions intended for intravenous infusion to a patient, and also for blood for transfusions. It goes without saying that an imperfect sterility of the package contents may have fatal consequences in such cases.

A connection to the interior of the container for supplying or drawing off liquid is mostly obtained in such a way that a point is made to penetrate the container wall so that a connection is obtained. In most cases, the point is hollow and can, for example, be the needle of a hypodermic syringe or of an infusion aggregate. Liquid is then drawn off or added through the channel in the needle, at which process several problems may occur. Such a problem is obtaining a safe seal where the needle penetrates the container wall. Another problem is obtaining a seal when the needle has been withdrawn after completed addition of liquid to the package, the packages mostly being made of a sheet material that has inferior self-sealing properties. This means that the sheet material is not sufficiently elastic to contract so that the hole is closed and sealing is obtained after withdrawal of the needle, but the resulting hole is still open so that leakage and bacterial contamination occur. Certain sheet materials, especially those based on rubber, have good self-sealing properties, but they are less suitable for the production of packages as they have unsuitable mechanical and optical properties, are difficult to heat-seal and are also difficult to sterilize.

There are also liquid packages of flexible sheet materials which already in their manufacture have been provided with passages of various types for supplying or drawing off liquid. Bag-shaped packages for infusion solutions can for example be provided with two passages, one having a rubber membrane for addition of liquid and the other being tubular for connection to an infusion aggregate for administration of the infusion solution to a patient. However, also such passages have disadvantages. Thus, the manufacture and handling of the packages will be much more troublesome and expensive than in the manufacture of simple "cushion packages". Besides, it may occur that several additions to the liquid in the package must be carried out before its use, and consequently the rubber membrane in the passage for additions must be penetrated with a hollow needle a number of times. This considerably increases the risk of rubber particles being released from the membrane and getting out into the solution. Moreover, the fixed passages will make it more difficult to arrange an outer protective bag around the package, which is often required to protect the package contents against light and penetrating gases before use. Finally, the preformed passages constitute potential places of leakage and are weak points in an otherwise sealed and durable package.

The disadvantages indicated above are eliminated by this invention. According to the invention there is provided a device for achieving a sealed liquid connection to the interior of a liquid container of a flexible sheet material, a point being made to penetrate the container wall to provide a liquid connection for the addition or withdrawal of liquid. According to the invention, the device is provided with a pressure sensitive adhesive or binder on a surface which is intended to be applied to the container wall, said adhesive adhering to the container wall and being arranged such that the area intended to adhere to the container wall will surround the place where the point is intended to penetrate the container wall. The device of the invention is to be attached to the container after it has been filled, and before liquid is to be added or withdrawn.

The device of the invention can be embodied in a number of ways. In its easiest embodiment, the device consists quite simply of a sheet of a material with self-sealing properties, e.g. a rubber membrane, which is provided on one side with a layer of a pressure sensitive adhesive. A piece of the sheet of a suitable size is applied to the container wall and is attached to it by means of the adhesive on the place where the point is to be inserted through the container wall. The point of, for example, a hypodermic syringe which has been filled with the liquid to be added is thereafter inserted through the sheet and the wall so that a liquid connection to the interior of the container is obtained, after which the liquid can be injected. Inversely, it is of course also possible to use an empty syringe and to draw out a desired amount of liquid in the package. In both cases, the inserted point will be tightly surrounded by the sheet due to the self-sealing properties of the latter, and after withdrawal of the point, the hole in the sheet will contract so that the package is sealed again. If several additions or withdrawals are to be made, a new sheet is used in each case, so that the risk is reduced that particles of the sheet material will be introduced into the package. By leaving the sheet on the package after addition or withdrawal, the package will also be marked so that it is clearly apparent which measures have been taken. In this way the risk is thus reduced that the same addition or withdrawal is carried out more times than intended, and this gives a greater security. The piece of sheet applied can also be made such that the pressure sensitive adhesive is only applied along a peripheral area, while the area in the middle where the point is inserted is free of adhesive. This reduces the risk of the package contents getting into contact with the adhesive.

Additional embodiments of the invention are illustrated in the accompanying drawings. In the drawings, FIGS. 1, 2, 3 show one embodiment, in which the self-adhering foil is connected with a chamber for collecting and portioning of a liquid and with a point of penetrating the container wall.

Figure 1:
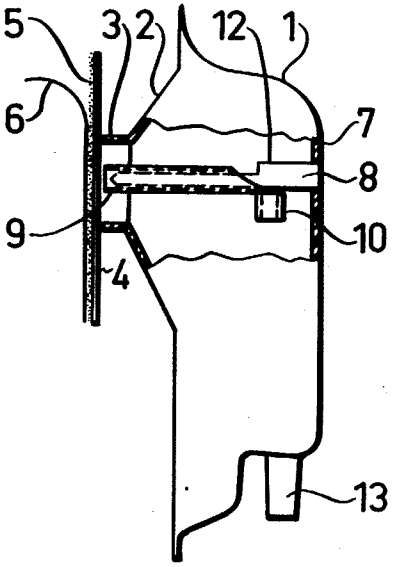
Figure 2:
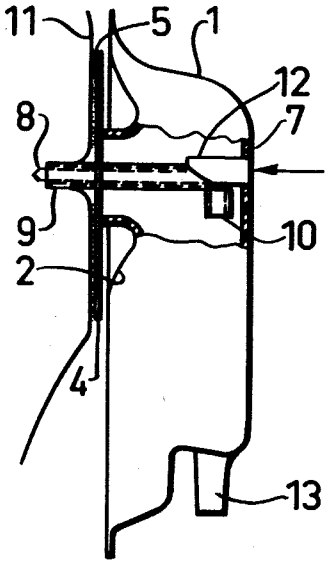
Figure 3:
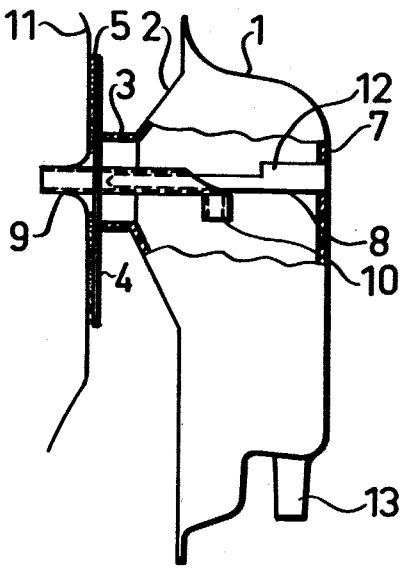

FIGS. 1–3 are schematic sectional views of a connection device according to the invention to a liquid container of a plastic foil material. FIG. 1 shows how the connection means is formed as a chamber 1 for collecting and dosing liquid. The chamber is for example made as a drop chamber for infusion. The chamber is provided with a conical connection piece 2 which is connected to a cylindrical portion 3 which is flanged out to a portion 4 intended to be attached to the container wall. For this the flanged portion 4 is provided with a layer 5 of a pressure sensitive adhesive or binder. Before use, this layer can in a known manner protected by a foil 6, which is provided with a release agent so that it can easily be removed from the layer 5.

At the rear wall 7 of the chamber 1 a point 8 for penetration of the container wall is attached. The point is surrounded by a tube 9, which prevents the point 8 from being exposed before the package wall is to be penetrated. The point 8 does not completely fill the tube 9 but allows flow of liquid through the tube. This can be effected in such a way that the point is provided with longitudinal grooves or that it is made hollow in some suitable way. The tube 9 can be provided with a device 10 for drop formation, especially when the chamber is intended to serve as a drop chamber for infusion or transfusion. The detailed embodiment of the drop forming means 10 can be determined by one skilled in the art.

FIG. 2 shows how the device has been applied to the wall 11 of a container of a plastic sheet material and how the point 8 and the tube 9 have penetrated the container wall. The flanged portion 4 is attached to the container wall 11 by means of the adhesive layer 8, after which the rear wall 7 of the chamber 1 with the point 8 is pushed forwards against the container wall 1, as shown by the arrow. This is possible because the chamber 1 is made of a stiff but still elastic plastic material. This applies especially to the conical portion 2, which must be able to be turned inside out, as is apparent from FIG. 2, and then to spring back, as shown in FIG. 3. When the rear wall 7 is pressed forwards, the point 8 attached to the wall will also be pressed forwards through the tube 9 so that the front end of the point is exposed and can penetrate the container wall 11. The tube will then be brought along by a shoulder 12 on the point 8 so that it will also penetrate the hole made by the point in the container wall. Liquid can now flow out through the tube 9.

FIG. 3 shows the device after releasing the pressure against the rear wall 7 of the chamber. The conical portion 2 has then sprung back and the point 8 has been drawn back through the tube 9. However, the tube is retained in the hole in the container wall 11 by friction and liquid can flow through the tube and channels in the point (not shown) to the drop forming means 10. The liquid can thereafter be led off through the connection 13, which can be made in a conventional manner.

By the arrangement of the tube 9 around the point 8, the advantage is obtained that the point cannot penetrate the container wall in advance, as its front end is not exposed before the rear chamber wall 7 is pressed forwards. Moreover, there is no risk that the point after penetration of the container 1 will also damage the opposite wall in the container as the point is retracted when the pressure on the rear wall of the chamber is released. However, as the tube 9 remains in the hole in the container wall, a constant liquid connection is secured.

The interior of the chamber 1 can be sterilized in or after its manufacture and is then protected by the applied foil 6. The part of the container wall where the connection means is to be applied is sterilized immediately before being applied, such as by washing with alcohol. Thus, in this way a completely sterile connection to the liquid container can be obtained, as the interior of the chamber will not come into contact with the exterior environment at the penetration of the container wall and the withdrawal of liquid.

Figure 6:
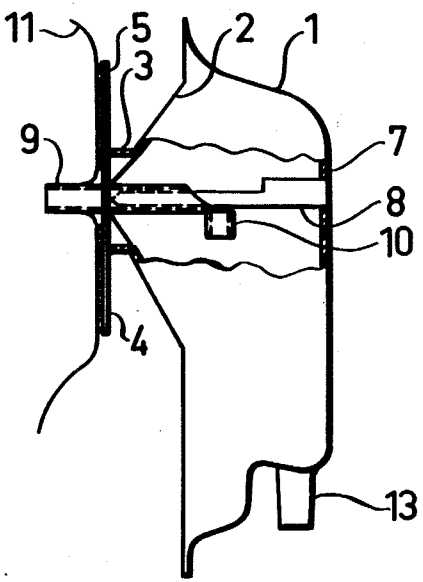
FIGS. 4, 5, 6 show a similar embodiment provided with a chamber, wherein the arrangement of the point penetrating the container wall is different.
Figure 5:
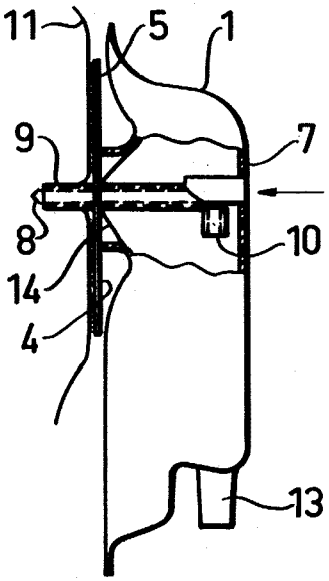
Figure 4:
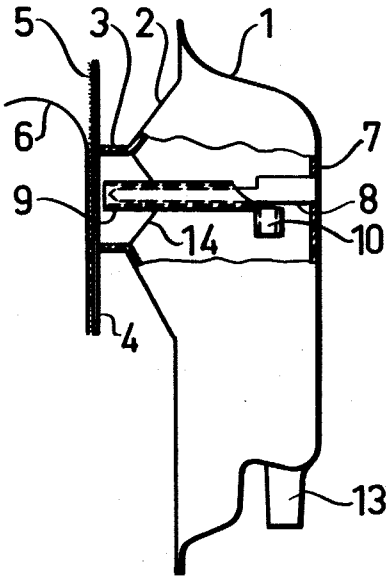

FIGS. 4, 5 and 6 show another embodiment of the connection chamber shown in FIGS. 1, 2, 3, like parts having the same reference numerals. Here the tube 9 is attached coaxially to a snap mechanism, e.g., a conical portion 14 of an elastic material, the peripheral portion of which is attached to the connection between the conical portion 2 and the cylindrical portion 3 of the chamber 1. Before use, the narrow portion of the cone is directed backwards towards the rear wall 7 of the chamber, as shown in FIG. 4.

When the rear chamber wall 7 is pressed forwards as is illustrated by the arrow in FIG. 5, the conical portion 2 will first be turned inside out and the point 8 will penetrate the container wall in the same way as indicated in connection with FIG. 2. At an additional pressure forwards the shoulder 12 on the point 8 will press the tube 9 forwards and as this is attached to the conical portion 14 this portion will flip over so that its narrow end is now pointing forwards and, thus retains the tube 9 in a forward position.

In FIG. 6 it is shown how pressure against the rear chamber wall 7 is released so that the point has been retracted due to the conical portion 2 resuming its original form. However, the conical portion 14 will retain its new shape, and will therefore hold the tube 9 in the hole of the container wall 1 even if the frictional force is not sufficient to ensure this.

Through this embodiment, a completely sterile connection to a liquid container of a sheet material can also be obtained.

Figure 9:
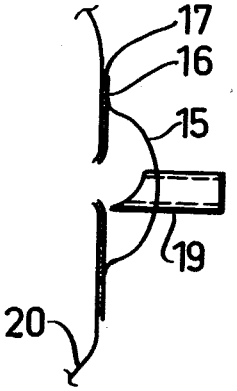
FIGS. 7, 8, 9 show a simpler device for drawing off liquid from a container of a sheet material.
Figure 8:
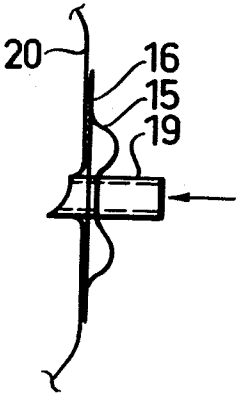
Figure 7:
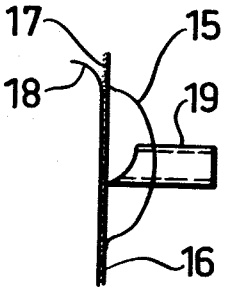

FIGS. 7, 8 and 9 show a simpler construction to obtain a liquid connection to a liquid container of a sheet material. According to FIG. 7, the device simply consists of a cup-shaped chamber portion 15, which is provided with an outwardly flanged portion 16 intended to be attached to the container wall by means of a pressure sensitive adhesive 17. Before being applied, the adhesive is protected in a conventional manner by a foil 18, which is provided with a release agent. In the cup-shaped portion 15 a hollow point 19 is placed allowing connection with the interior of the chamber.

FIG. 8 shows how the chamber portion is attached to a container wall 20, after which pressure is applied in the direction of the point 19 so that the cup-shaped chamber portion 15 is buckled inwards and the point 19 will penetrate the container wall. When the pressure is released, the chamber portion 15 will spring back and bring along the point 19, as shown in FIG. 9. In this way a tight liquid connection with the interior of the container is obtained in a simple way.

Figure 10:
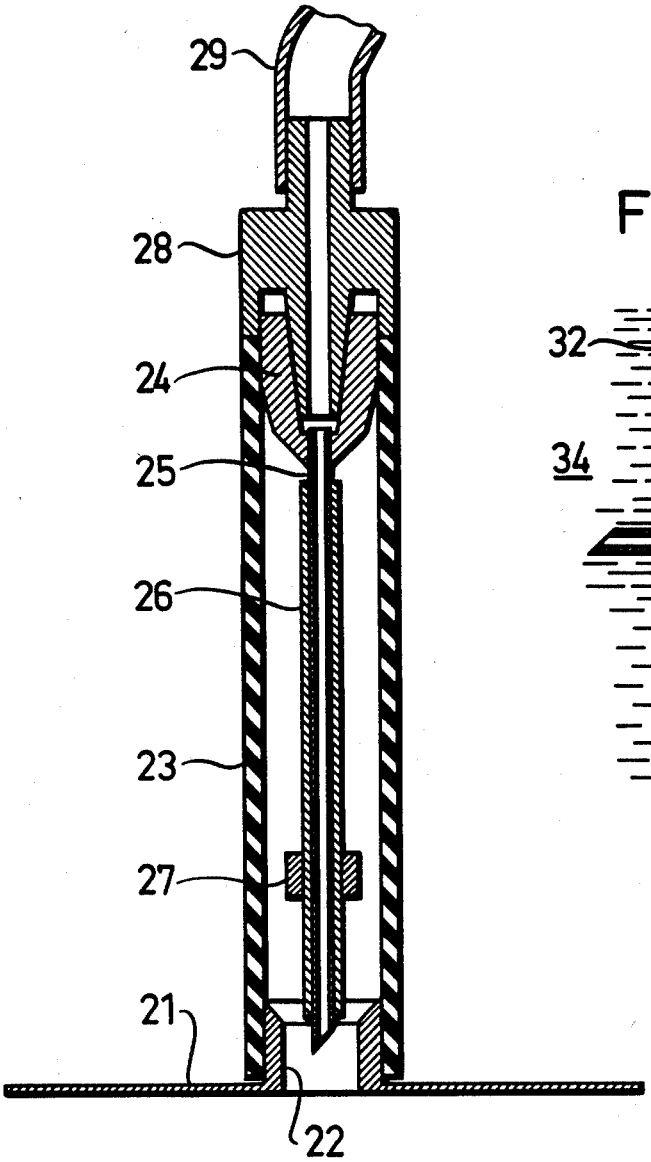
FIG. 10 shows connection means for a syringe point to a package for liquids.

FIG. 10 shows another embodiment of the connection means according to the invention. A sheet 21, which is intended to be attached to a container wall by means of a pressure sensitive adhesive, is here provided with a casing 22, which is tightly connected to a tube 23. The tube 23 is made of a flexible material such as rubber or plastic and can also be formed as a bellows. At its other end, the tube is tightly connected to a holder 24 for a hollow syringe needle 25. The syringe needle 25 is surrounded by a tube 26, which is slideably arranged on the syringe needle and is provided with an arresting shoulder 27. The holder 24 of the syringe needle 25 is in its turn connected to connection means 28 of a conventional type for a liquid conduit 29.

At connection to a liquid container of a sheet material, the pressure sensitive adhesive surface of the sheet 21 is first applied to the container wall and attached to it. Before use, the surface with the adhesive and the interior of the tube 23 are preferably protected against contamination by means of a foil provided with a releasing agent (not shown) in the same way as indicated previously. After applying the sheet 21 to the container wall, the syringe needle 25 is pressed against the container wall so that the wall is penetrated. As the length of the tube 26 is adapted such that its rear end rests against the holder 24 of the syringe needle 25 when this has just been made free, the tube 26 will also be inserted into the hole made in the container wall. The shoulder 27 will then prevent the tube 26 from being inserted too far. The introduction of the syringe point 25 is made possible as the tube 23 is made of an easily flexible material such as rubber or plastic and in a preferred embodiment the tube is even formed as a bellows so that it can be easily compressed. However, the tube 23 should have a sufficient elasticity to revert to its original form when the pressure forwards onto the syringe needle is released. At this release of pressure, the syringe needle will be drawn back through the hole in the container wall while the tube 26 will remain in the hole by the friction so that the hole is kept open and a liquid connection is assured. As the syringe point is drawn back immediately after penetration of the container wall, there is no risk that it will damage the opposite wall of the container. This risk is otherwise great when the container has been emptied to some extent and has started to collapse due to its softness.

After the penetration of the container wall and the removal of the syringe needle 25 liquid can flow from the container out through the tube 27, the syringe needle 25, the connection means 28 and the liquid line 29. All these parts can be maintained sterile before use and the connection to the liquid container can also take place under sterile conditions so that complete safety is obtained, such as at an intravenous infusion or at a blood transfusion. Of course there is nothing preventing use of the device for addition of material under sterile conditions.

Figure 11:
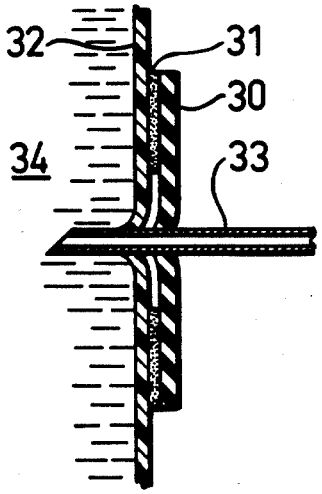
FIG. 11 shows the device of the invention in its simplest embodiment, consisting only of a piece of sheet provided with adhesive.

FIG. 11 shows the simplest embodiment of the connection device according to the invention. Here a sheet 30 of a material with self-adhesive properties is attached to the container wall 32 by means of a layer 31 of a pressure sensitive adhesive. For the sake of clearness, the thicknesses of the sheet 30, the adhesive layer 31 and the container wall 32 are shown exaggerated. A hollow syringe needle is pushed through the sheet 30 and the container wall 32, and the contents of the liquid package can be drawn off through this needle or be provided with additional material. After accomplished withdrawal or addition of material, the syringe needle is withdrawn, whereby the hole in the sheet 30 is constructed by the self-sealing and elastic properties of the sheet so that a seal is obtained. On the other hand, the container wall 32 is mostly made of a less elastic material, and therefore the hole in it will not be contracted to sealing.

It is also apparent from FIG. 11 that the adhesive 31 need not be applied over the whole surface of the sheet 30 but only in an annular area along the periphery of the sheet. In this way the possibility of a contact between the contents of package and the adhesive is reduced.

A sterile connection can also be achieved by the embodiment shown in FIG. 11. The area of the package wall where the sheet is to be applied is first washed with a bactericide, such as alcohol, and the sheet can be kept under sterile conditions before being applied. Before applying the surface is protected with a protective foil treated with a release agent.

The embodiments shown above have primarily been concerned with connection to containers of a flexible sheet material which are always intended to contain a liquid. However, it is to be noted that the invention is not merely restricted to this. Thus, preparations for enteral diet compositions intended for introduction through a tube are packed sterilely in powder form in bags of a plastic sheet material. Before administration water is to be added to the powder and optionally also other liquids to give a liquid preparation for administration. This supply of liquid to the sterilely packed powder can be effected sterilely by connection means according to the invention, the package thus not containing any liquid initially. The withdrawal of the finished preparation for administration can also take place by a device according to the invention which can be the same as the device for the liquid supply.

Furthermore, it should be noted that the invention is not restricted merely to connection and withdrawing devices for use in the medical field, where great demands are made on sterility. For example, a simple device of the type shown in FIGS. 7–9 and which can be made cheaply can be used to provide a liquid connection to various bag-shaped consumer packages and large packages for various foodstuffs and other preparations such as milk and juice, and also for packages for such materials as motor oil, etc. Also here the packages can be made of such materials as plastic sheet or paper coated with plastic. In each specific case, the advantages of the invention are obtained, i.e. a simple liquid-tight connection without leakage. The liquid package itself need not be manufactured with finished and expensive connection means from the beginning.

For the manufacture of connection devices according to the invention, materials are selected which are well-known to one skilled in the art. Here various rubber and plastic materials are primarily used, and in the cases when the materials are to have special properties such as self-sealing properties, elasticity, flexibility etc, such materials can be easily selected by one skilled in the art on the basis of known material specifications. In the primarily considered uses, viz. in the medical and surgical field, it is of importance that the used materials can be sterilized easily and safely, such as by heat, ionizing radiation or chemical means. Among suitable plastic materials can be mentioned polyolefins such as polyethylene and polypropylene, halogenated polyolefins, such as polyvinyl chloride and fluorine plastics, polyamides such as various types of nylon, and polyesters such as polyethylene terephthalate. As rubber materials can be used various types of natural and synthetic rubber. The materials used can also contain various auxiliary substances such as fillers and plasticizers, but care must be taken so that the agent used will not have any deleterious influence on the package contents with which they come into contact.

The pressure sensitive adhesives used are also of importance. Mostly it is not intended to remove the contact-adhesive sheet from the container before it has been emptied, and therefore a connection which is as permanent and strong as possible is desired. Furthermore, an adhesive should be selected which has no detrimental effect on the package contents if they get in contact with each other. The tackiness of the adhesive is also decided by the types of material which are to be joined. Considering these and other parameters, an expert can choose among a great number of known compositions for pressure sensitive adhesives and can also select a suitable release agent for treatment of protective foils for the adhesive.

By the present invention, a device for obtaining a liquid-tight connection to a liquid package of a sheet material is provided, wherein it is secured that liquid can be supplied or drawn off without any risk of waste or contamination of the package contents. In this way, the liquid package can be made simpler and at a lower cost.

It is to be noted that the embodiments of the invention shown are only examples and are not intended to restrict the invention. The invention can also exist in other modifications and embodiments within the scope of the claims.

We claim:

1. A device for providing a sealed liquid connection to the interior of a liquid container with walls of a flexible sheet material, the device including a retractable point for penetrating a wall of the container to supply or draw off liquid; a pressure sensitive adhesive on a surface of the device which is adapted to be applied to the container wall after the container has been filled, the adhesive being arranged such that the area of the device which will adhere to the container wall by means of the adhesive will completely surround the location where the point will penetrate the container wall; and a tube surrounding the point and coupled to the point in a manner which constrains the tube for movement with the point through the container wall when the point is moved in a direction to penetrate the container wall and allows the tube to continue to protrude through the hole made in the wall after the point is retracted.

2. The device of claim 1, wherein the tube surrounding the point is attached to a snap mechanism, which snap mechanism flips over when the point and the tube are inserted to a position which prevents withdrawal of the tube as the point is being retracted.

* * * * *